US007254967B2

(12) United States Patent
Kim et al.

(10) Patent No.: US 7,254,967 B2
(45) Date of Patent: Aug. 14, 2007

(54) DRUM-TYPE WASHING MACHINE EQUIPPED WITH DRYING DEVICE

(75) Inventors: Jae-Myong Kim, Seoul (KR); Kwang-Su Kim, Yongin (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 595 days.

(21) Appl. No.: 10/397,242

(22) Filed: Mar. 27, 2003

(65) Prior Publication Data

US 2004/0045327 A1 Mar. 11, 2004

(30) Foreign Application Priority Data

Sep. 10, 2002 (KR) ..... 2002-54390

(51) Int. Cl.
*D06F 39/04* (2006.01)

(52) U.S. Cl. ..... 68/19.2; 68/20

(58) Field of Classification Search ..... 68/20, 68/19.2, 19.1; 34/77
See application file for complete search history.

(56) References Cited

U.S. PATENT DOCUMENTS 2,843,943 A * 7/1958 Geldhof et al. ..... 34/75
2,873,537 A * 2/1959 Gray, Jr. et al. ..... 34/75
2,940,179 A * 6/1960 Czech ..... 34/77
2,961,865 A * 11/1960 Frey ..... 68/207
3,012,333 A * 12/1961 Leonard ..... 34/75
3,598,131 A * 8/1971 Weihe, Jr. ..... 134/107
3,631,923 A * 1/1972 Izeki ..... 165/167
3,866,333 A * 2/1975 Sarukahanian et al. ..... 34/75
5,983,520 A * 11/1999 Kim et al. ..... 34/261

FOREIGN PATENT DOCUMENTS

| | | | |
|---|---|---|---|
| EP | 1 094 141 A2 | | 4/2001 |
| FR | 2 646 501 | * | 11/1990 |
| GB | 2 172 978 | * | 10/1986 |
| GB | 2 215 826 | * | 9/1989 |
| JP | 2-241486 | * | 9/1990 |
| JP | 11-164981 | | 6/1999 |
| KR | 1995-0018857 | | 7/1995 |
| KR | 1019980184189 | | 12/1998 |

OTHER PUBLICATIONS

European Patent Office 0 485 700 May 1992.*

* cited by examiner

*Primary Examiner*—Frankie L. Stinson
(74) *Attorney, Agent, or Firm*—Staas & Halsey LLP

(57) ABSTRACT

A drum-type washing machine is equipped with a drying device, which increases condensing efficiency by increasing the contact of air flowing along a condensing duct with cooling water, and prevents water formed in a condensing duct from flowing into a fixed drum. The washing machine is equipped with a drying device, which includes a discharging duct to connect an outlet of a blowing fan with an air inlet of a fixed drum and provided with a heater therein, and a condensing duct to connect an air inlet of the fixed drum with an inlet of the blowing fan and provided with a condensing unit to remove moisture. The condensing unit includes a cooling water dispersion member disposed in the lower portion of the inside of the condensing duct and a cooling water supply pipe configured to supply cooling water to the cooling water dispersion member.

14 Claims, 7 Drawing Sheets

DRUM-TYPE WASHING MACHINE EQUIPPED WITH DRYING DEVICE

CROSS-REFERENCE TO RELATED APPLICATIONS

This application claims the benefit of Korean Application No. 2002-54390, filed Sep. 10, 2002, in the Korean Intellectual Property Office, the disclosure of which is incorporated herein by reference.

BACKGROUND OF THE INVENTION

1. Field of the Invention

The present invention relates generally to a drum-type washing machine, and more particularly, to a drum-type washing machine equipped with a drying device that dries laundry.

2. Description of the Related Art

In general, a drying device for a drum-type washing machine evaporates the moisture of laundry by supplying hot air heated by a heater to the inside of a fixed drum and heating the laundry and condensing and discharging the evaporated moisture, thus drying the laundry.

Such a drying device is provided with a discharging duct and a condensing duct. The discharging duct provides hot air to the inside of a fixed drum, and is provided with a heater therein. One end of the discharging duct is connected to the outlet of a blowing fan and the other end of the discharging duct is connected to communicate with the inside of the fixed drum. The condensing duct is used to condense vapor into water and discharge the water to the outside while guiding the vapor formed in the inside of the fixed drum to the blowing fan, and is provided with a condenser. One end of the condensing duct is connected to communicate with the inside of the fixed drum and the other end of the condensing duct is connected to the inlet of the blowing fan.

As shown in FIG. 1, a condensing duct 1 of a conventional drying device extends from an air outlet 3 formed in the lower portion of the back of a fixed drum 2 to an inlet 5 of a blowing fan 4 formed in the upper portion of the back of the fixed drum 2, and is mounted on the back of the fixed drum 2 in an airtight manner. The condensing duct 1 is provided with a condenser that includes a cooling water spray nozzle 6 and a cooling water supply pipe 7. The cooling water spray nozzle 6 is used to spray cooling water inside the condensing duct 1 and is mounted to the upper portion of the inside of the condensing duct 1. The cooling water supply pipe 7 supplies the cooling water to the cooling water spray nozzle 6.

When the blowing fan 4 is operated, wet vapor discharged from the inside of the fixed drum 2 through the air outlet 3 is moved upward along the condensing duct 1 from the suction of the blowing fan 4. The cooling water sprayed into the lower portion of the fixed drum 2 through the cooling water spray nozzle 6 condenses the wet vapor that was moving upward. The condensed vapor then drops down the condensing duct 1 where it is removed.

However, since the cooling water spray nozzle 6 that sprays cooling water is mounted on the upper portion of the inside of the condensing duct 1 in the conventional drying device for the drum-type washing machine, some of the cooling water that is sprayed downward is sucked to the blowing fan 4 together with the ascending air current, thus decreasing the efficiency of drying laundry.

SUMMARY OF THE INVENTION

Accordingly, in order to solve the problem, it is an aspect of the present invention to provide a drum-type washing machine equipped with a drying device, which is capable of increasing condensing efficiency by increasing the contact of air flowing along a condensing duct with cooling water, and is capable of preventing water formed in a condensing duct from flowing into a fixed drum.

Another aspect of the present invention is to provide a drum-type washing machine equipped with a drying device that is capable of decreasing the amount of cooling water supplied to the inside of a condensing duct.

Additional aspects and advantages of the invention will be set forth in part in the description which follows and, in part, will be obvious from the description, or may be learned by practice of the invention.

The foregoing and/or other aspects of the present invention are achieved by providing a drum-type washing machine equipped with a drying device that includes a discharging duct configured to connect an outlet of a blowing fan with an air inlet of a fixed drum, and a condensing duct configured to connect an air inlet of the fixed drum with an inlet of the blowing fan and provided with a condensor to remove moisture. The condensor includes a cooling water dispersion member supplying cooling water to an inside of the condensing duct while dispersing the cooling water and an ascent limitation projection mounted in the condensing duct to prevent condensate water from moving upward together with an air current.

The cooling water dispersion member may have a certain width, a certain length, and a semicircular cross section to form a water capture part having a certain depth. One side surface of the cooling water dispersion member may be positioned on an inner surface of the condensing duct to partially block the air flow in the condensing duct. A plurality of holes may be formed in the cooling water dispersion member at positions where the cooling water dispersion member contacts the inner surface of the condensing duct to pass cooling water and air through the cooling water dispersion member.

In addition, the cooling water dispersion member may be positioned above the air outlet of the fixed drum and may be fixed to the inner surface of the condensing duct facing the air outlet of the fixed drum.

The ascent limitation projection may protrude from the inner surface of the condensing duct so that its length crosses the direction of air flow. The condensing duct may have a certain curvature, and the ascent limitation projection may be mounted where the radius of curvature of the condensing duct is relatively large.

In addition, the drum-type washing machine may include a condensate water capture projection. The condensate water capture projection may be positioned below the ascent limitation projection where the radius of curvature of the condensing duct is relatively small so that condensate water drops falling from the ascent limitation projection are captured thereon.

The drum-type washing machine also may include a cooling water supply hole formed in the condensing duct so that the cooling water is supplied to the cooling water dispersion member from a cooling water supply pipe passing through the cooling water supply hole.

In addition, rising from the bottom to the top, the cross-section area of the condensing duct may increase so that the flow rate of air is reduced travelling in an upward direction.

BRIEF DESCRIPTION OF THE DRAWINGS

These and/or other aspects and advantages of the present invention will become apparent and more appreciated from the following detailed description of the embodiments, taken in conjunction with the accompanying drawings of which.

DETAILED DESCRIPTION OF THE PREFERRED EMBODIMENTS

Figure 1:
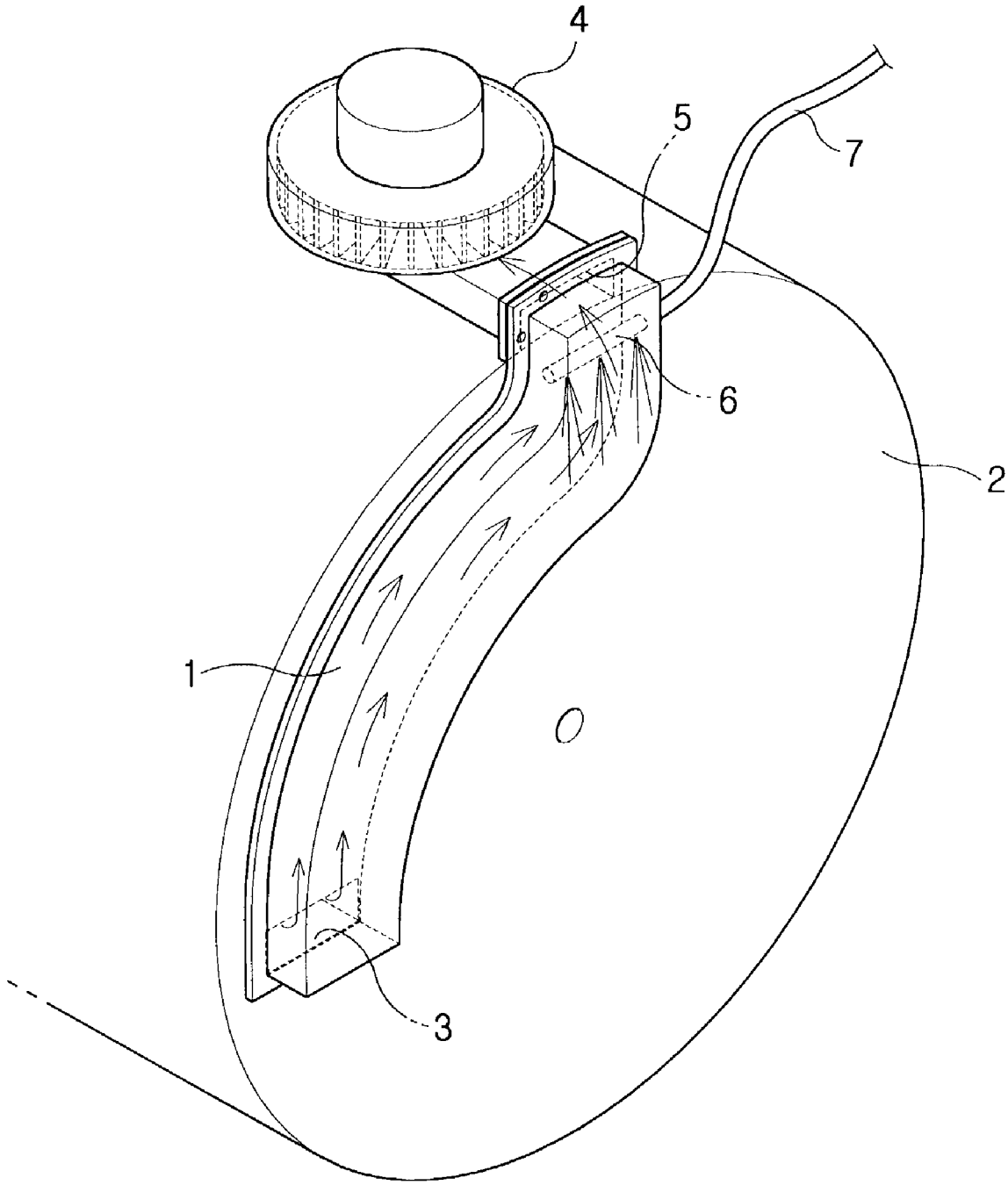
FIG. 1 (PRIOR ART)
FIG. 1 is a perspective view showing the construction of a condensing duct of a conventional drying device for a drum-type washing machine.

Reference will now be made in detail to embodiments of the present invention, examples of which are illustrated in the accompanying drawings. Like reference numerals refer to like elements throughout.

Figure 2:
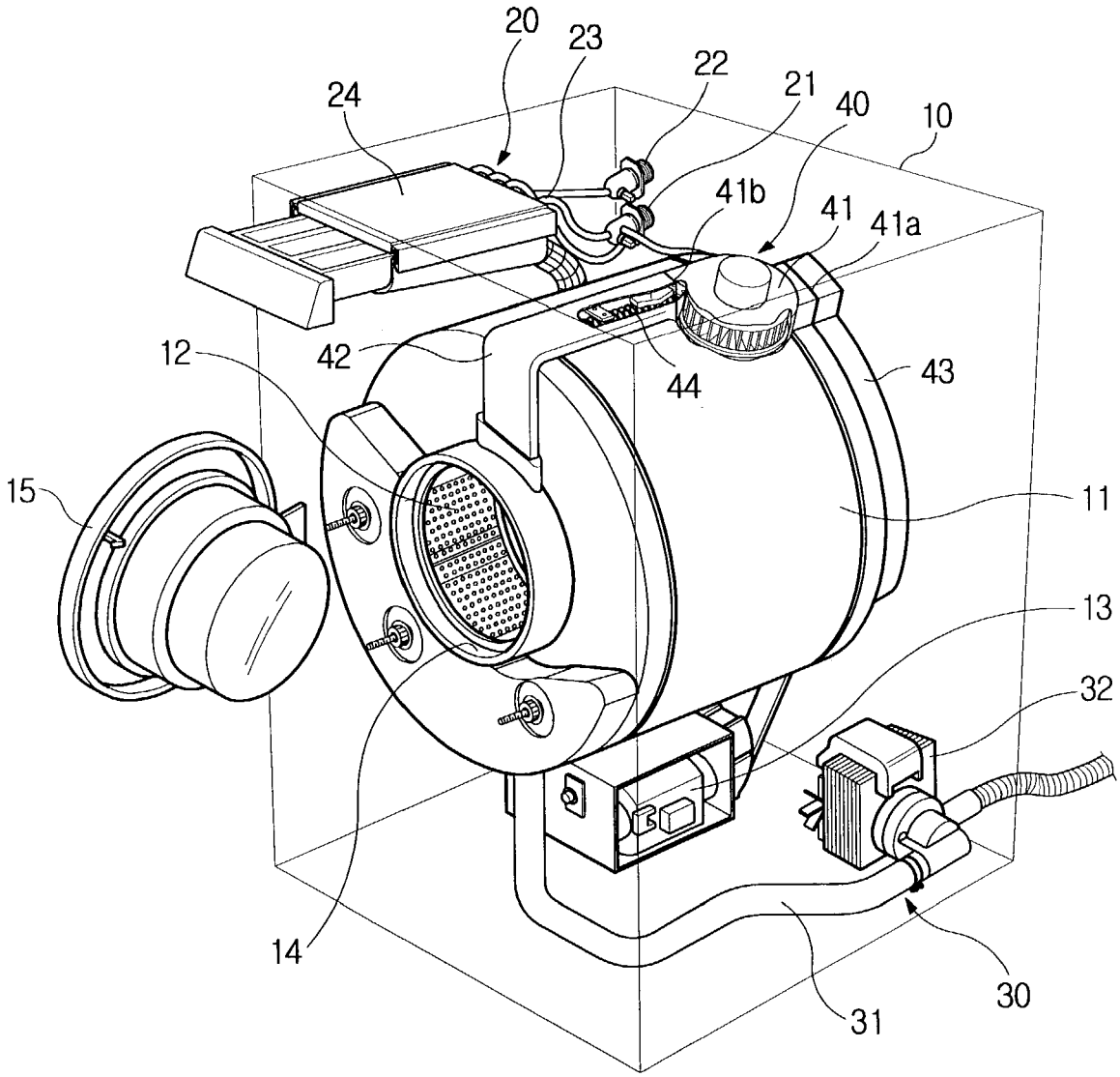
FIG. 2 is a perspective view showing the construction of a drum-type washing machine in accordance with an embodiment of the present invention.
Figure 3:
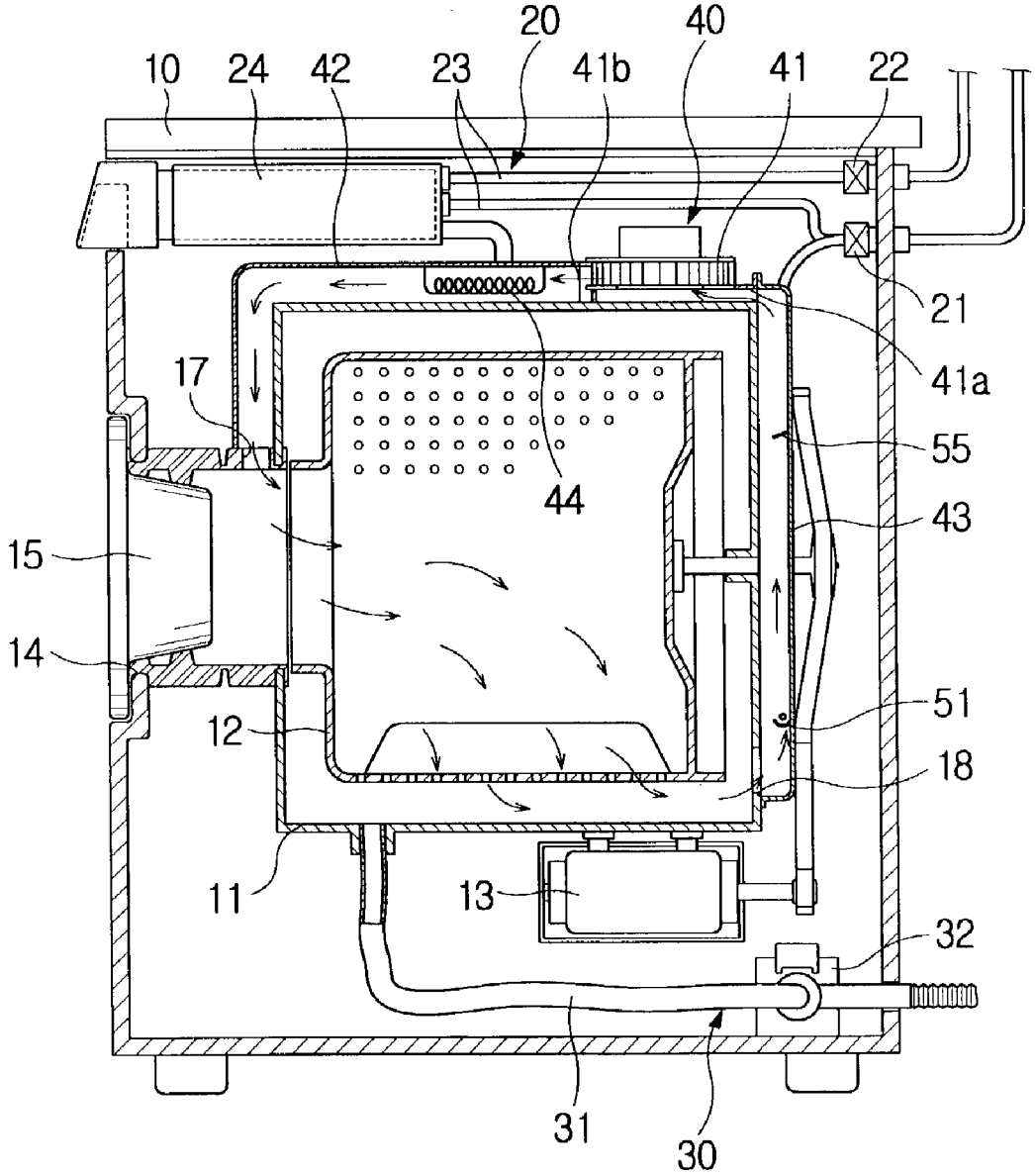
FIG. 3 is a sectional view showing the construction of the drum-type washing machine of FIG. 2.

As shown in FIGS. 2 and 3, a drum-type washing machine of the present invention includes a cylindrical fixed drum 11 positioned in a cabinet 10 to contain washing water, and a rotary drum 12 disposed to rotate in the fixed drum 11. The rotary drum 12 is provided with a number of perforations formed on the surface thereof. A drive motor 13 is positioned below the fixed drum 11 to perform washing, rinsing and spin-drying processes by rotating the rotary drum 12 in forward and reverse directions. An opening 14 in the front of the fixed drum 11 and the rotary drum 12 allows a user to access laundry from the front of the cabinet 10. A door 15 in the front of the cabinet 10 opens and closes the opening 14.

A water supply unit 20 is disposed over the fixed drum 11 to dissolve detergent and to supply washing water to the fixed drum 11. The water supply unit 20 includes water supply valves 21 and 22, water supply pipes 23, and a detergent dissolving device 24. A discharge unit 30 is disposed under the fixed drum 11 to forcibly discharge washing water that remains inside the fixed drum 11. The discharge unit 30 includes a discharge pipe 31 and a discharge pump 32.

The drum-type washing machine is equipped with a drying device 40 to dry laundry after the spin-drying process. The drying device 40 includes a blowing fan 41 mounted on the fixed drum 11, a discharging duct 42 that connects an outlet 41*b* of the blowing fan 41 with an air inlet 17 formed in the upper portion of the opening 14, and a condensing duct 43 mounted on the back of the fixed drum 11 to connect an air outlet 18 in the lower rear portion of the fixed drum 11 with an inlet 41 a of the blowing fan 41.

The drying device 40 also includes a heater 44 mounted in the discharging duct 42 to supply hot air to the inside of the fixed drum 11 and a condenser disposed in the condensing duct 43 to condense and remove moisture from the wet vapor. The wet vapor is produced by passing the hot air through the wet laundry. The wet vapor then is pulled up into the condensing duct 43 by the suction of the blowing fan 41 where the moisture is condensed and removed.

Figure 4:
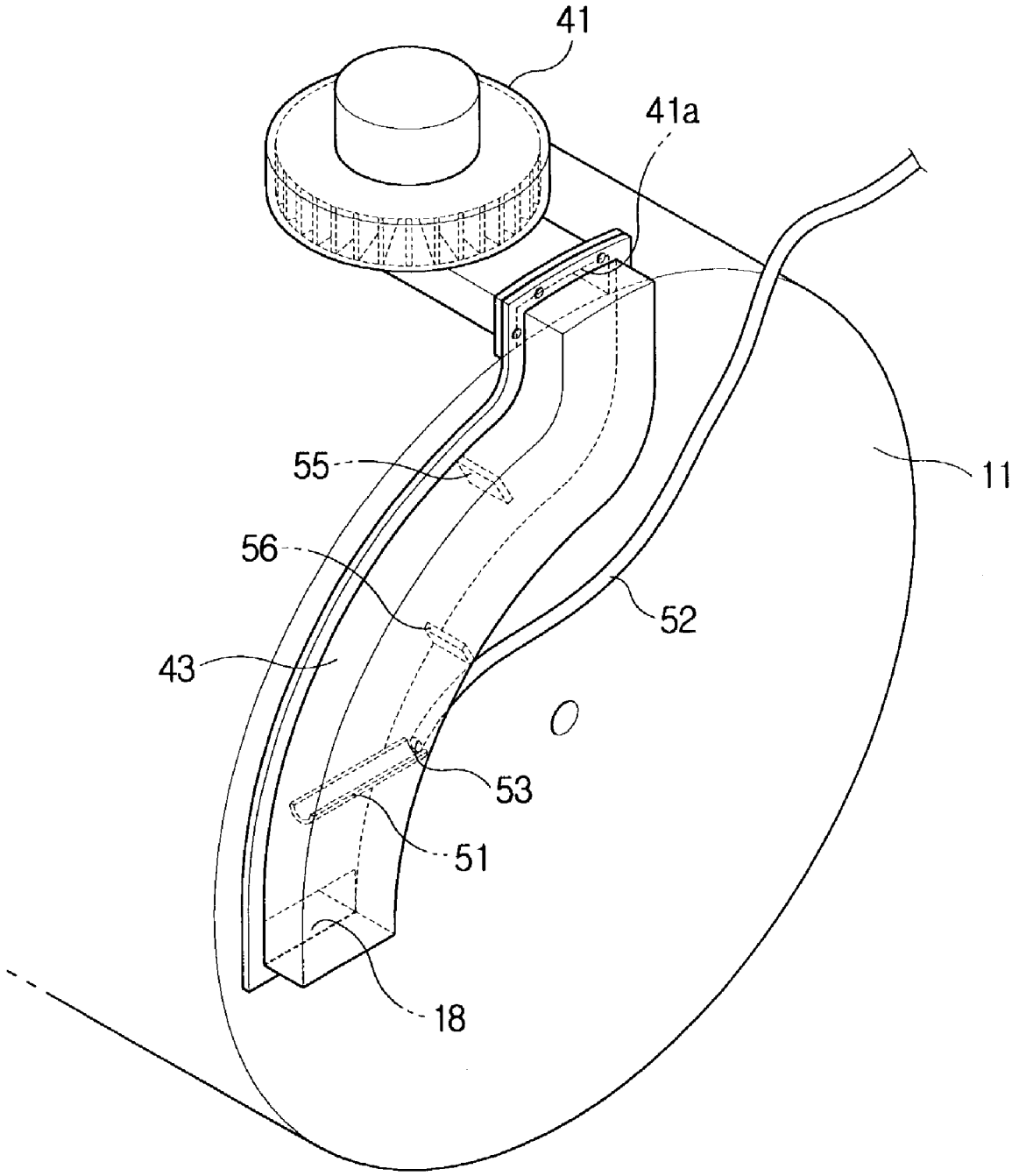
FIG. 4 is a front perspective view showing the construction of a condensing duct and a condenser of a drying device of the drum-type washing machine of FIG. 2.
Figure 5:
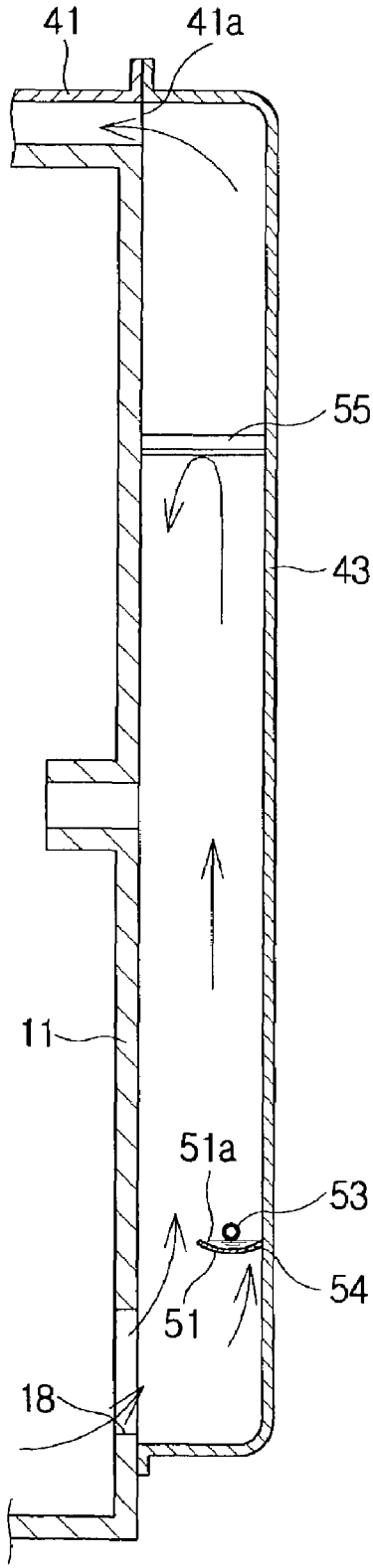
FIG. 5 is a sectional view showing the construction of the condensing duct and the condensor of the drying device of the drum-type washing machine.
Figure 6:
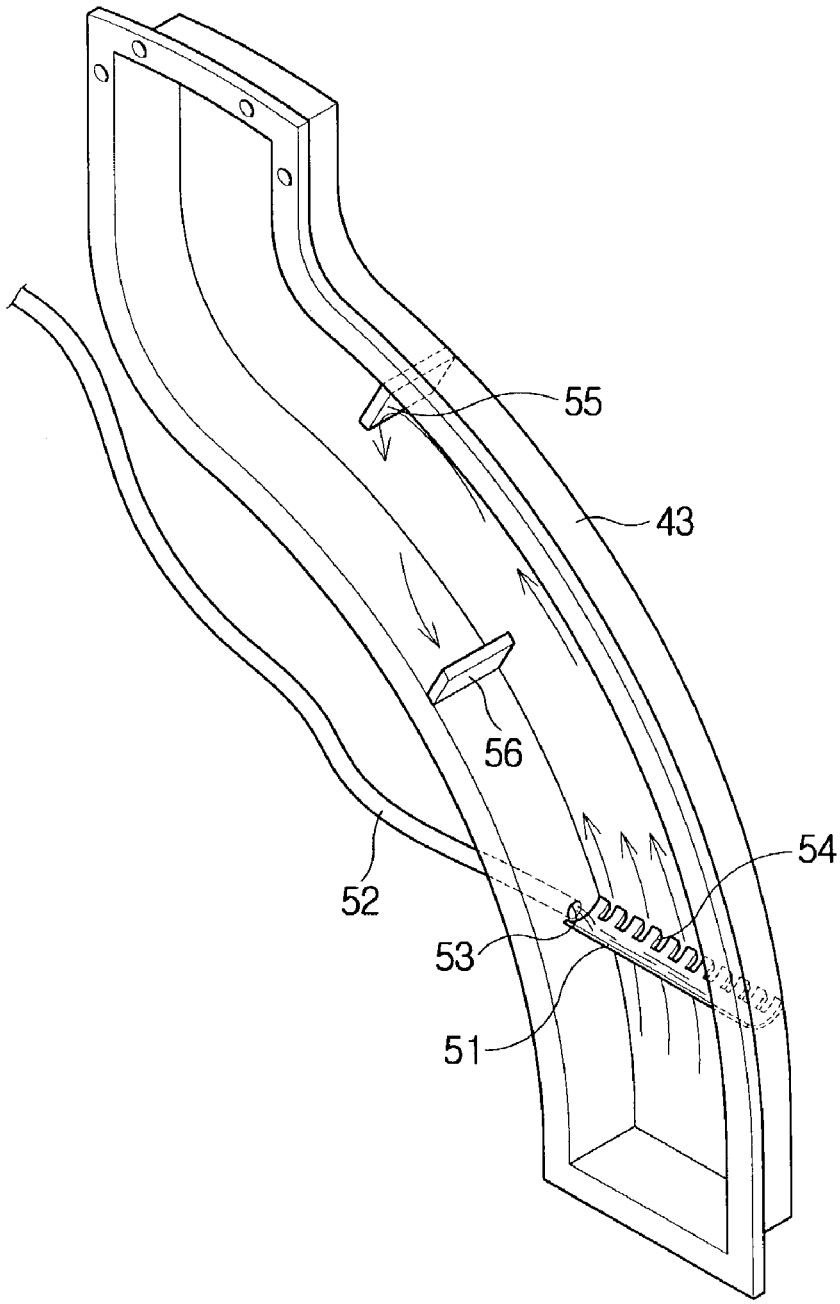
FIG. 6 is a rear perspective view showing the construction of the condensing duct of the drying device of the drum-type washing machine.

As shown in FIGS. 4 to 6, the condensing duct 43 forms a flow path that connects the air outlet 18 in the back of the fixed drum 11 with the inlet 41*a* of the blowing fan 41. The curved condensing duct 43 has one open surface that is sealed by contact with the back surface of the fixed drum 11 and the outlet 41*a* of the blowing fan 41.

The condenser includes a cooling water dispersion member 51 disposed in the lower portion of the inside of the condensing duct 43, a cooling water supply pipe 52 which supplies cooling water to the cooling water dispersion member 51, an ascent limitation projection 55 which limits the ascent of condensate water that is positioned in the upper portion of the inside of the condensing duct 43, and a condensate water capture projection 56 which allows the condensate water falling down from the ascent limitation projection 55 to be captured thereby.

Figure 7:
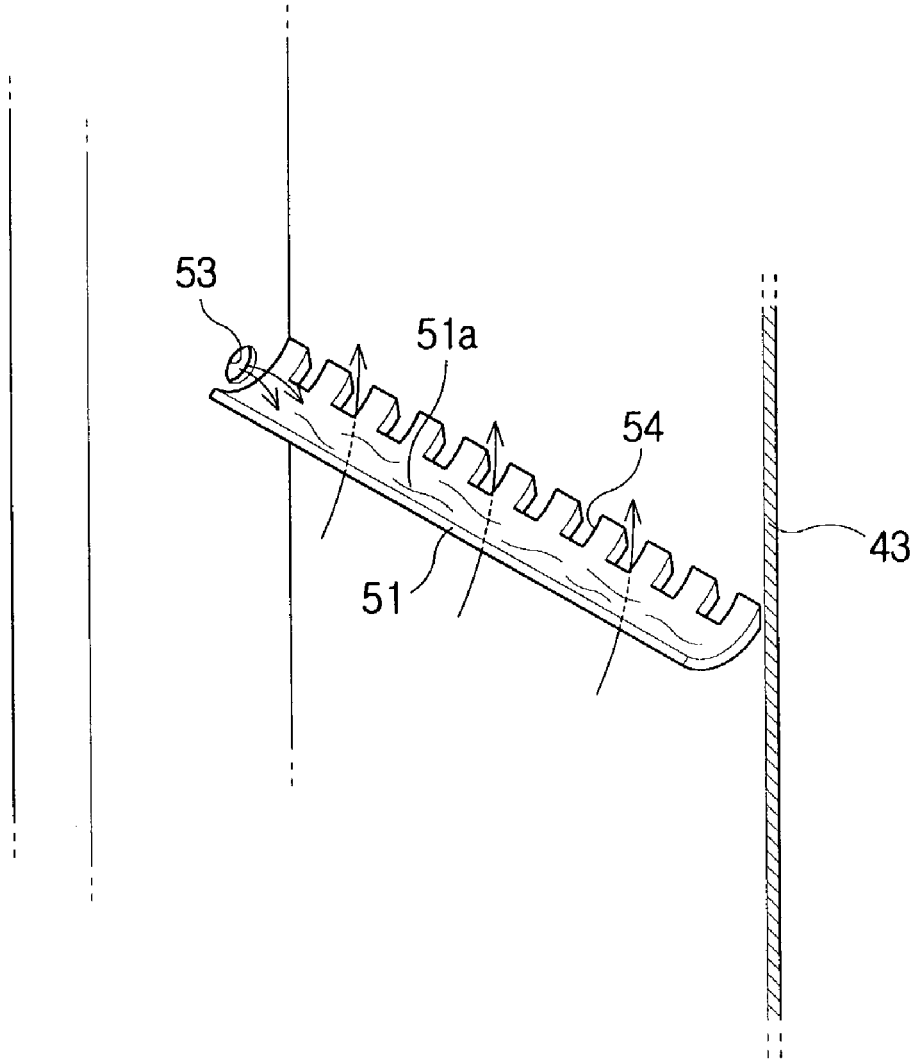
FIG. 7 is a perspective view showing the construction of the cooling water dispersion member of the drying device of the drum-type washing machine of FIG. 2.

As shown in FIGS. 5 to 7, the cooling water dispersion member 51 has a width and a length, and is formed with a semicircular cross section so that a water capture part 51*a* having a depth to capture a certain amount of water is formed on the upper surface thereof. In addition, the cooling water dispersion member 51 is positioned lengthwise across the direction of air flow in the condensing duct 43 above the air outlet 18 of the fixed drum 11. The cooling water dispersion member 51 is fixed to the inner surface of the condensing duct 43 on the side facing the air outlet 18 of the fixed drum 11 (see FIG. 5).

In addition, as shown in FIG. 7, a plurality of holes 54 spaced at intervals are formed in the side of the cooling water dispersion member 51 in contact with the condensing duct 43 to allow water and air to flow through the cooling water dispersion member 51. A cooling water supply hole 53 is formed in the side of the condensing duct 43 to supply the cooling water to the water capture part 51*a* of the cooling water dispersion member 51, and is connected to the cooling water supply pipe 52 connected to the water supply unit 20.

The above-described construction of the cooling water dispersion member 51 causes air that is moving upward in the condensing duct 43 to pass through the holes 54. Cooling water captured in the water capture part 51*a* that would otherwise flow downward through the holes 54 is forced upward by the ascending air current. Therefore, the contact of the air with the cooling water is increased, which increases the condensing efficiency The cooling water dispersion member 51 is fixed to the inside surface of the condensing duct 43 facing the air outlet 18 of the fixed drum 11 at a position where the airflow rate is relatively large to greatly increase the dispersion efficiency of the cooling water.

As shown in FIGS. 4 to 6, the ascent limitation projection 55 protrudes from the inner surface of the condensing duct 43 with a length crossing the direction of air flow to limit the ascent of the condensate water condensed by the cooling water. Accordingly, minute condensate water droplets ascending in the condensing duct 43 are hindered from further upward flow into the blowing fan 41 by the ascent limitation projection 55. Thus, the moisture content of the air which flows into the inlet 41*a* of the blowing fan 41 is reduced and drying efficiency is increased. Drying efficiency is further increased by positioning the ascent limitation projection 55 where the radius of curvature of the condensing duct 43 is relatively large since air flows more rapidly as the radius of curvature becomes larger. The area inside the condensing duct 43 becomes larger toward the top of the condensing duct 43 so that the flow rate of ascending air is reduced. This also helps to prevent the condensate water from flowing into the inlet 41*a* of the blowing fan 41.

The condensate water capture projection 56 is mounted to the inner surface of the condensing duct 43 at a position where the radius of curvature thereof is smaller than the curvature near the ascent limitation projection 55, and below the ascent limitation projection 55. The shape of the condensate water capture projection 56 is similar to that of the ascent limitation projection 55. The condensate water that is hindered from ascending in the condensing duct 43 by the ascent limitation projection 55 falls downward and is captured by the upper surface of the condensate water capture projection 56. The captured condensate water rises again on the ascending air current only to be blocked once again by the ascent limitation projection 55, so condensing efficiency is further increased and cooling water is conserved by the repeating cycle of contact of the condensate water with the air.

Hereinafter, operation of the drum-type washing machine is described in accordance with the present invention.

The drying operation begins after completing a spin-drying operation. The drive motor 13 slowly rotates the rotary drum 12 so that the laundry falls downward as it revolves in the rotary drum 12. The blowing fan 41 draws air in the fixed drum 11 into the condensing duct 43 and then the air is discharged back into the fixed drum 11 and the rotary drum 12 through the discharging duct 42. The air is heated in the discharging duct 42 by the heater 44 to dry the laundry in the rotary drum 12.

Cooling water is provided from the cooling water supply pipe 52 to the cooling water dispersion member 51 inside the condensing duct 43 as wet vapor flows upward in the condensing duct 43. The cooling water then falls downward through the holes 54 in the cooling water dispersion member 51. The fast flow of air ascending inside the condensing duct 43 causes the cooling water to ascend along the inner surface of the condensing duct 43. Once again, the cooling water falls downward after ascending for a certain period of time. Contact between the cooling water and the wet vapor condenses moisture from the wet vapor which is then removed. Moisture in the ascending air is also condensed by contact with the lower surface of the cooling water dispersion member 51.

In addition, the condensate water is hindered from further upward movement by the lower surface of the ascent limitation projection 55, causing water drops to form on the lower surface of the ascent limitation projection 55. Accordingly, the air flowing into the blowing fan 41 contains very little moisture, so the efficiency of drying the laundry is significantly increased in comparison with that of other laundry drying machines.

The water drops that are formed on the lower surface of the ascent limitation projection 55 freely fall downward and are captured on the upper surface of the condensate water capture projection 56, which are then dispersed again in a repetitive cycle. Since the contact of the ascending air current with the water is increased by the process, the efficiency of condensing moisture in the air is further increased, thus further increasing the efficiency of drying laundry.

As described above, the cooling water dispersion member, which induces the dispersion of cooing water in the condensing duct, is arranged in the lower portion of the condensing duct and condensate water is prevented from being moved upward by the ascent limitation projection, so that water in the condensing duct is prevented from flowing into the fixed drum, thus increasing drying efficiency. In addition, since cooling water is dispersed while ascending along the inner surface of the condensing duct by the ascending air current, the contact of air flowing in the condensing duct with the cooling water is increased, thus increasing condensing efficiency. Since the cooling water repeats a cycle of ascending and falling in the condensing duct, the amount of the cooling water supplied to the condensing duct is decreased. Any excess, condensate water drops down into the fixed drum 11 where it is pumped out by the discharge pump 32 in the discharge unit 30 described above.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A drum-type washing machine equipped with a drying device, the drying device including a discharging duct configured to connect an outlet of a blowing fan with an air inlet of a fixed drum, and a condensing duct configured to connect an air inlet of the fixed drum with an inlet of the blowing fan and provided with a condensing unit to remove moisture, the condensing unit comprising:

a cooling water dispersion member supplying cooling water to an inside of the condensing duct while dispersing the cooling water; and an ascent limitation projection mounted in the condensing duct to prevent condensate water from being moved upward together with an air current, wherein said cooling water dispersion member has a certain width and a certain length, with a water capture part having a certain depth being formed on an upper surface of the cooling water dispersion member, one side surface of the cooling water dispersion member being fixed to come into contact with an inner surface of the condensing duct and to be arranged in a direction crossing a flow direction of air in the condensing duct, and a plurality of holes being formed at positions where the cooling water dispersion member comes into contact with the inner surface of the condensing duct to pass cooling water and air through the cooling water dispersion member.

2. The drum-type washing machine as set forth in claim 1, wherein said cooling water dispersion member is formed to have a semicircular cross section.

3. The drum-type washing machine as set forth in claim 1, wherein said cooling water dispersion member is placed at a position higher than that of the air outlet of the fixed drum, and is fixed to the inner surface of the condensing duct facing the air outlet of the fixed drum.

4. The drum-type washing machine as set forth in claim 1 further comprising a cooling water supply hole formed in the condensing duct so that the cooling water is supplied to the cooling water dispersion member, and a cooling water supply pipe connected to the cooling water supply hole.

5. The drum-type washing machine as set forth in claim 1, wherein a cross section area of the condensing duct is upwardly increased so that the flow rate of air is reduced in an upward direction.

6. A drum-type washing machine equipped with a drying device, the drying device including a discharging duct configured to connect an outlet of a blowing fan with an air inlet of a fixed drum, and a condensing duct configured to connect an air inlet of the fixed drum with an inlet of the blowing fan and provided with a condensing unit to remove moisture, the condensing unit including a curved portion having a minimum rate of deviation and increasing to a maximum rate of deviation relative to a straight portion of the condensing duct, the condensing unit comprising:

a cooling water dispersion member supplying cooling water to an inside of the condensing duct while dispersing the cooling water;

an ascent limitation projection mounted in the condensing duct to prevent condensate water from being moved upward together with an air current, said ascent limitation projection protruding from the inner surface of the condensing duct, and extending in a direction crossing the flow direction of air, and said ascent limitation projection is mounted on a portion of the inner surface of the condensing duct proximate to the maximum rate of deviation of the curved portion; and a condensate water capture projection, the condensate water capture projection being formed at a position lower than that of the ascent limitation projection on a portion of the inner surface of the condensing duct proximate to the minimum rate of deviation of the curved portion so that condensate water falling downward from the ascent limitation projection is captured thereon.

7. A condensing unit in a laundry machine, comprising:

a condensing duct;

a cooling water dispersion member mounted to an inside surface of the condensing duct, the cooling water dispersion member disbursing cool water inside the condensing duct;

an ascent limitation member mounted above the cooling water dispersion member on the inside surface of the condensing duct, the ascent limitation member causing moist vapor in the condensing duct to condense into water droplets;

a condensate water capture projection positioned between the ascent limitation member and the cooling water dispersion member, the condensate water capture projection capturing water droplets falling from the ascent limitation member; and a cooling water supply tube supplying water to the cooling water dispersion member; and wherein the cooling water dispersion member includes a curved portion to contain a water volume.

8. The condensing unit of claim 7, wherein the cooling water dispersion member includes holes.

9. The condensing unit of claim 7, wherein the ascent limitation member is rectangular.

10. The condensing unit of claim 7, wherein the condensing duct includes a curved portion with a rate of deviation relative to a straight portion of the condensing duct.

11. The condensing unit of claim 10, wherein the ascent limitation member is positioned in the condensing duct proximate to a maximum rate of deviation of the curved portion.

12. The condensing unit of claim 10, wherein the cooling water dispersion member is positioned in the condensing duct below a maximum rate of deviation of the curved portion.

13. The condensing unit of claim 10, wherein a cross-sectional area of the condensing duct increases in an upward direction.

14. A condensing unit in a laundry machine, comprising:

a condensing duct;

a cooling water dispersion member mounted to an inside surface of the condensing duct, the cooling water dispersion member disbursing cool water inside the condensing duct;

an ascent limitation member mounted above the cooling water dispersion member on the inside surface of the condensing duct, the ascent limitation member causing moist vapor in the condensing duct to condense into water droplets; and a cooling water supply tube supplying water to the cooling water dispersion member, wherein:

the cooling water dispersion member includes a curved portion to contain a water volume, the condensing duct includes a curved portion with a rate of deviation relative to a straight portion of the condensing duct, the curved portion includes an upper wall and a lower wall, the upper wall having a longer radius of curvature relative to the lower wall, the ascent limitation member is positioned on the upper wall, and the water dispersion member is positioned on the lower wall.

* * * * *

UNITED STATES PATENT AND TRADEMARK OFFICE

CERTIFICATE OF CORRECTION

PATENT NO. : 7,254,967 B2
APPLICATION NO. : 10/397242
DATED : August 14, 2007
INVENTOR(S) : Jae-Myong Kim et al.

It is certified that error appears in the above-identified patent and that said Letters Patent is hereby corrected as shown below:

Column 6, Line 58, after "1" insert --,--.

Signed and Sealed this

Eighteenth Day of December, 2007

JON W. DUDAS
*Director of the United States Patent and Trademark Office*